US011065743B2

(12) United States Patent
Chiang

(10) Patent No.: US 11,065,743 B2
(45) Date of Patent: Jul. 20, 2021

(54) TOOL HOLDER DEVICE

(71) Applicant: Wen Hung Chiang, Taichung (TW)

(72) Inventor: Wen Hung Chiang, Taichung (TW)

( * ) Notice: Subject to any disclaimer, the term of this patent is extended or adjusted under 35 U.S.C. 154(b) by 286 days.

(21) Appl. No.: 16/415,797

(22) Filed: May 17, 2019

(65) Prior Publication Data

US 2019/0270187 A1 Sep. 5, 2019

Related U.S. Application Data

(63) Continuation-in-part of application No. 14/710,877, filed on May 13, 2015, now abandoned.

(51) Int. Cl.
*B25B 21/00* (2006.01)
*B25B 23/00* (2006.01)

(52) U.S. Cl.
CPC ..... *B25B 21/002* (2013.01); *B25B 21/007* (2013.01); *B25B 23/0028* (2013.01); *B25B 23/0035* (2013.01)

(58) Field of Classification Search
CPC . B25B 21/002; B25B 21/007; B25B 23/0028; B25B 23/0035
See application file for complete search history.

(56) References Cited

U.S. PATENT DOCUMENTS

| | | | | |
|---|---|---|---|---|
| 1,420,635 | A | 6/1922 | Klopper | |
| 2,637,233 | A | 5/1953 | Hoffman | |
| 2,694,953 | A | 11/1954 | Williams | |
| 3,124,022 | A | 3/1964 | Corson | |
| 3,696,694 | A * | 10/1972 | Boro | B25B 17/00 81/57.27 |
| 4,474,089 | A | 10/1984 | Scott | |
| 4,913,007 | A | 4/1990 | Reynolds | |
| 5,499,557 | A | 3/1996 | Fry | |
| 5,673,758 | A | 10/1997 | Sasaki et al. | |
| 6,009,776 | A | 1/2000 | Warren | |
| 6,363,819 | B1 | 4/2002 | Li | |
| 7,018,298 | B1 | 3/2006 | Chiou | |
| 7,121,951 | B2 | 10/2006 | Chang | |
| 7,228,767 | B2 | 6/2007 | Chang | |
| 7,278,342 | B1 | 10/2007 | Chang | |
| 7,363,839 | B2 | 4/2008 | Chiang | |
| 7,392,727 | B1 | 7/2008 | Chiang | |
| 7,481,136 | B2 | 1/2009 | Chiang | |
| 8,371,394 | B2 | 2/2013 | Grand | |
| 2010/0000749 | A1 | 1/2010 | Andel | |

* cited by examiner

*Primary Examiner* — David B. Thomas
(74) *Attorney, Agent, or Firm* — Muncy, Geissler, Olds & Lowe, P.C.

(57) ABSTRACT

A tool holder device includes a receptacle having two conduits perpendicular to each other, a spindle and a shaft are rotatably engaged in the conduits of the receptacle and have bevel gears meshed with each other for allowing the shaft to be rotated relative to the receptacle by the spindle, a housing is secured to the receptacle, a flexible shank is secured to the spindle, a stem is secured to the flexible shank, a flexible sheath is engaged onto the flexible shank and is secured to the receptacle, and a control ferrule is secured to the flexible sheath, and the stem is rotatably received and engaged in the control ferrule. The flexible shank and the flexible sheath allow the tool holder device to be easily operated by the user in a tiny working space.

12 Claims, 6 Drawing Sheets

TOOL HOLDER DEVICE

FIELD OF THE INVENTION

The present invention is a CIP of application Ser. No. 14/710,877, filed May 13, 2015, the entire contents of which are hereby incorporated by reference.

BACKGROUND OF THE INVENTION

Description of the Prior Art

Typical universal joints or tool extensions comprise two or more parts or elements or sections or couplings pivotally or rotatably connected or coupled together for connecting or coupling various kinds of different tool elements or fasteners to various kinds of driving tools.

For example, U.S. Pat. No. 7,018,298 to Chiou, U.S. Pat. No. 7,121,951 to Chang, U.S. Pat. No. 7,228,767 to Chang, U.S. Pat. No. 7,278,342 to Chang, U.S. Pat. No. 7,363,839 to Chiang, U.S. Pat. No. 7,392,727 to Chiang, and U.S. Pat. No. 7,481,136 to Chiang disclose several of the typical universal joints or tool extensions for various kinds of driving tool devices or the like each also comprising two or more pivotally coupled parts or elements or sections or coupling members for connecting or coupling various kinds of different driving tools to selectively engage with various kinds of different tool elements or fasteners and to drive or rotate the same.

However, the pivotally coupled parts or elements or sections or couplings may not be solidly and stably anchored or secured or retained in the predetermined or required position that the pivotally coupled parts or elements or sections or couplings are tilted or inclined relative to each other, and may not be used to solidly and stably engage with the other or different tool elements or fasteners such that the tool elements or fasteners may not be suitably or effectively rotated or driven by various kinds of driving tool devices, and the typical universal joints or tool extensions may not be solidly and stably held or supported by the users and may not be worked or operated in the tiny working space.

The present invention has arisen to mitigate and/or obviate the afore-described disadvantages of the conventional universal joints or tool extensions, tool coupling or connecting devices, or tool holder devices.

SUMMARY OF THE INVENTION

The primary objective of the present invention is to provide a tool holder device including an elbow member for carrying or holding or supporting or retaining the tool members or tool elements at the predetermined or required position relative to the tool body, and for allowing the tool members or tool elements to be suitably or effectively actuated or operated by various kinds of driving tools, and including a flexible structure for being suitably or effectively actuated or operated by the users and for allowing the tool holder device to be operated in a tiny working space.

In accordance with one aspect of the invention, there is provided a tool holder device comprising a receptacle including a first conduit and a second conduit formed therein and perpendicular to each other and communicative with each other, a spindle is rotatably received and engaged in the first conduit of the receptacle, and the spindle includes a first end portion, and includes a second end portion rotatably engaged in the first conduit of the receptacle, and includes a first bevel gear provided on the second end portion of the spindle and located close to the second conduit of the receptacle, a shaft is rotatably received and engaged in the second conduit of the receptacle, and includes a second bevel gear provided thereon for engaging with the first bevel gear of the spindle and for allowing the shaft to be rotated relative to the receptacle by the spindle, the shaft includes an engaging hole formed therein for selectively engaging with a tool member, a housing includes an end portion secured to the receptacle, and includes a bore formed in the housing for receiving and engaging with the spindle, a flexible shank includes a first end portion secured to the first end portion of the spindle and rotated in concert with the spindle, and including a second end portion extended out of the spindle and the receptacle, a stem including a first end portion secured to the second end portion of the flexible shank and moved in concert with the flexible shank, the stem includes a second end portion, a flexible sheath is engaged onto the flexible shank and includes a first end portion secured to the receptacle, and includes a second end portion, and a control ferrule includes an end portion secured to the second end portion of the flexible sheath, and the stem is rotatably received and engaged in the control ferrule which may be provided for being grasped or held by the user.

The shaft is rotatably received and engaged in the second conduit of the receptacle with one or more bearing members and/or bushes or gaskets. The spindle rotatably received and engaged in the first conduit of the receptacle with one or more bearing members and/or bushes or gaskets. The housing includes a knurled outer portion for being frictionally grasped or held by the user and for allowing the stem and the flexible shank and the spindle to be suitably and effectively actuated or operated by the users and for allowing the tool holder device to be operated in a tiny working space.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
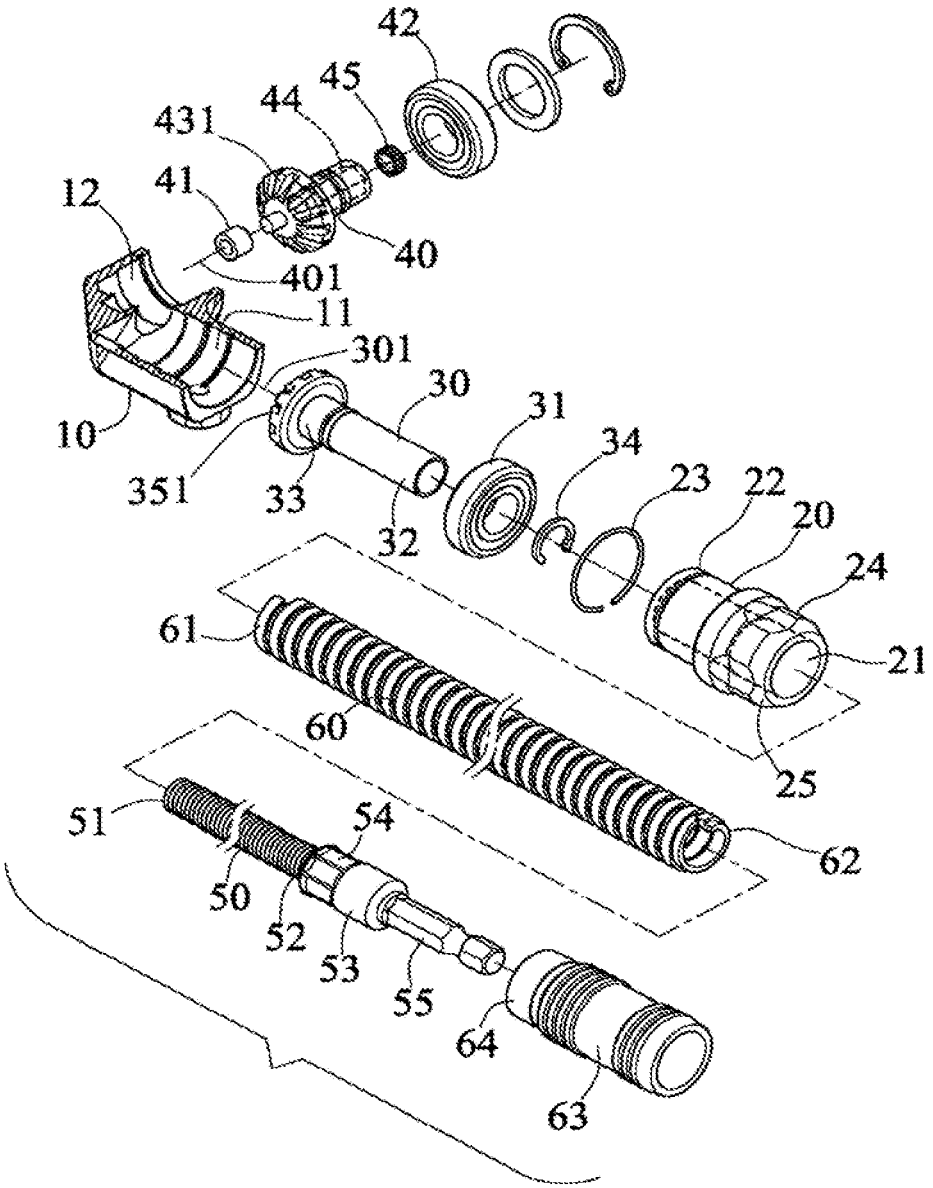
FIG. 1 is an exploded view of a tool holder device in accordance with the present invention.
Figure 2:
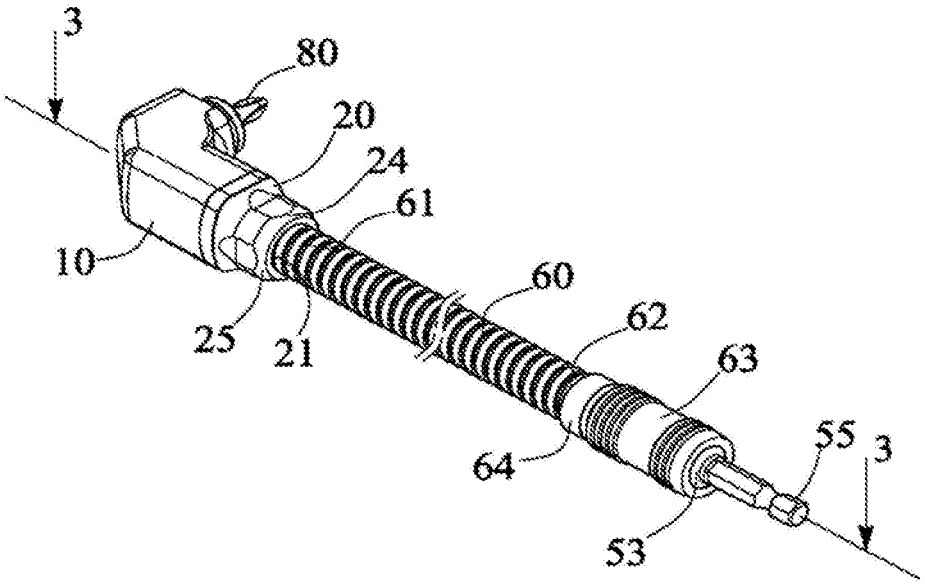
FIG. 2 is a perspective view of the tool holder device.
Figure 3:
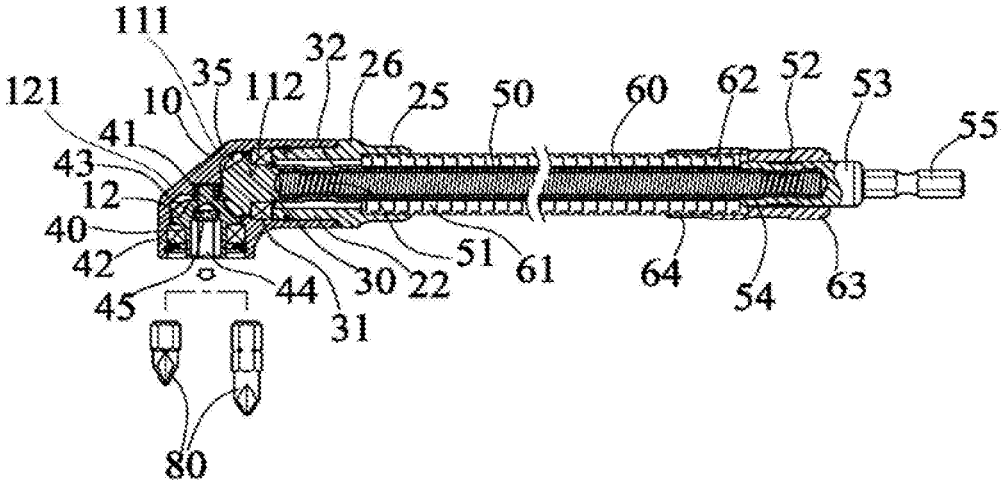
FIG. 3 is a cross sectional view of the tool holder device taken along lines 3-3 of FIG. 2.

Referring to the drawings, and initially to FIGS. 1-3, a tool holder device in accordance with the present invention comprises an elbow or receptacle 10 includes a C or L-shaped structure having two chambers or compartments or spaces or conduits 11, 12, such as a first conduit 11 and a second conduit 12 formed therein and substantially perpendicular to each other, and communicative with each other, the receptacle 10 may be made of plastic, metallic or synthetic materials. A supporting member or housing 20 includes a longitudinal bore 21 formed therein and formed through the length thereof, and includes an inner or first end portion 22 disposed or engaged into the first conduit 11 of the receptacle 10 and anchored or secured or retained to the receptacle 10 with a clamping or retaining ring 23. It is preferable, but not necessary that the housing 20 includes a rough or knurled outer portion 24 for being frictionally grasped by the user.

A stem or rod or spindle 30 is pivotally or rotatably received or engaged in the longitudinal bore 21 of the housing 20, and is also pivotally or rotatably received or engaged in the first conduit 11 of the receptacle 10 with one or more gaskets or bearing members 31 for allowing the spindle 30 to be smoothly pivoted or rotated relative to the housing 20 and the receptacle 10, and the spindle 30 includes an outer or first end portion 32 extended in the housing 20, and includes an inner or second end portion 33, and the bearing members 31 may be secured to the spindle 30 with a clamping or retaining ring 34, and the spindle 30 includes a bevel gear 35 formed or provided on the inner or second end portion 33 thereof and disposed or located close to the second conduit 12 of the receptacle 10.

A stem or rod or shaft 40 is pivotally or rotatably received or engaged in the second conduit 12 of the receptacle 10 with one or more barrels or sleeves or gaskets 41 and/or one or more bearing members 42 for allowing the shaft 40 to be smoothly pivoted or rotated relative to the receptacle 10, and includes another bevel gear 43 formed or provided thereon for meshing or engaging with the bevel gear 35 of the spindle 30 and thus for allowing the shaft 40 to be pivoted or rotated relative to the receptacle 10 with or by the spindle 30. The shaft 40 includes a non-circular engaging hole 44 formed therein (FIGS. 1, 3) for selectively receiving or engaging with the various kinds of fasteners or tool elements or tool members 80 (FIG. 3). A magnetic member 45 is received or engaged in the engaging hole 44 of the shaft 40 for attracting and anchoring or securing or retaining or locking the tool member 80 to the shaft 40.

A flexible shaft or core or shank 50 includes an inner or first end portion 51 disposed or engaged into the outer or first end portion 32 of the spindle 30 and solidly anchored or secured or retained to the spindle 30 with force-fitted engagements, adhesive materials, welding procedures and the like, for allowing the spindle 30 and the shank 50 to be pivoted or rotated or moved in concert with each other, and thus for allowing the spindle 30 to be selectively pivoted or rotated or driven by the flexible shank 50. The flexible shank 50 may be selected from spiral or helical spring or metal elements, torque transmitting spring members, coil spring members, or the like for transmitting the torque from the flexible shank 50 to the spindle 30. The flexible shank 50 includes an outer or second end portion 52 extended out of the spindle 30 and the receptacle 10.

A stem 53 includes one or first end portion 54 solidly anchored or secured to the outer or second end portion 52 of the flexible shank 50 with force-fitted engagements, adhesive materials, welding procedures and the like, for allowing the spindle 30 and the shank 50 and the stem 53 to be pivoted or rotated or moved in concert with each other, the stem 53 includes another or second end portion 55 having a non-circular or hexagonal cross section for selectively engaging with various kinds of driving tools (not shown) and thus for allowing the stem 53 and the flexible shank 50 and the spindle 30 to be pivoted or rotated or driven relative to the receptacle 10 and the housing 20 with or by the driving tools (not shown). The driving tools may be selected from hydraulic or pneumatic driving tools, wrenches, or the like.

A flexible outer housing or sheath 60 is disposed or engaged onto the flexible shank 50 and may also be selected from spiral or helical spring or metal elements, torque transmitting spring members, coil spring members, or the like, and includes one or first end portion 61 solidly anchored or secured to the other or second end portion 25 of the housing 20 with force-fitted engagements, adhesive materials, welding procedures and the like, and includes the other or second end portion 62 extended toward the stem 53 and solidly anchored or secured to the one end portion 64 of a barrel or sleeve or control ferrule 63 which is provided for being frictionally grasped or held by the user. It is preferable that the stem 53 is pivotally or rotatably received or engaged in the control ferrule 63 for allowing the stem 53 and the flexible shank 50 and the spindle 30 to be suitably and effectively pivoted or rotated or driven relative to housing 20 and the receptacle 10 with the driving tools (not shown).

Figure 8:
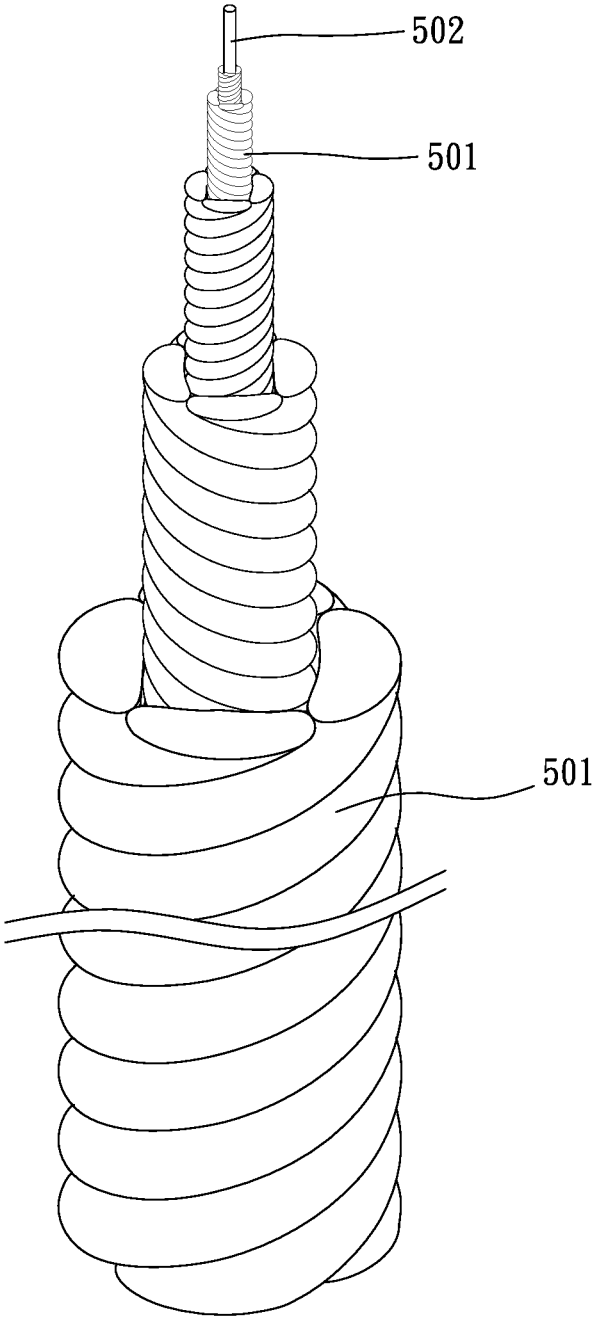
FIG. 8 is a partial enlargement of a flexible shank in accordance with the present invention.

Specifically, the first conduit 11 includes a first inner bevel face 111 which is slant relative to an axial 301 about which the spindle 30 rotates, and the first inner bevel face 111 faces and is substantially parallel to a top bevel face 351 of the first bevel gear 35 which is slant relative to the axial 301 about which the spindle 30 rotates. The second conduit 12 includes a second inner bevel face 121 which is slant relative to an axial 401 about which the shaft 40 rotates, and the second inner bevel face 121 faces and is substantially parallel to a top bevel face 431 of the second bevel gear 43 which is slant relative to the axial 401 about which the shaft 40 rotates. The first conduit 11 further includes an inner flange 112 connected with the first inner bevel face 111, the at least one bearing member 31 which is received in the first conduit 11 is abutted axially against the inner flange 112 and an distal end of the housing 20, the housing 20 further includes an outer flange 26, and the outer flange 26 is abutted axially against an distal end of the first conduit 11. As viewed in an axial direction of the first conduit 11, the outer flange 26 is aligned with the distal end of the first conduit 11. The flexible shank 50 further includes at least two winding member layers 501 sleeved with each other, and the at least two winding member layers 501 obliquely wind counter to and slant to each other. The flexible shank 50 includes more than two of said winding member layers 501 (for example, 5 winding member layers), and every neighboring two of the more than two of said winding member layers 501 obliquely wind counter to and slant to each other. Specifically, the flexible shank 50 further includes a central core wire 502 around which the at least two winding member layers 501 are disposed (as shown in FIG. 8). Whereby, torque from the driving tool can be efficiently transmitted to the shaft 40, and any of the at least two winding member layers 501 cannot be unwound.

Figure 4:
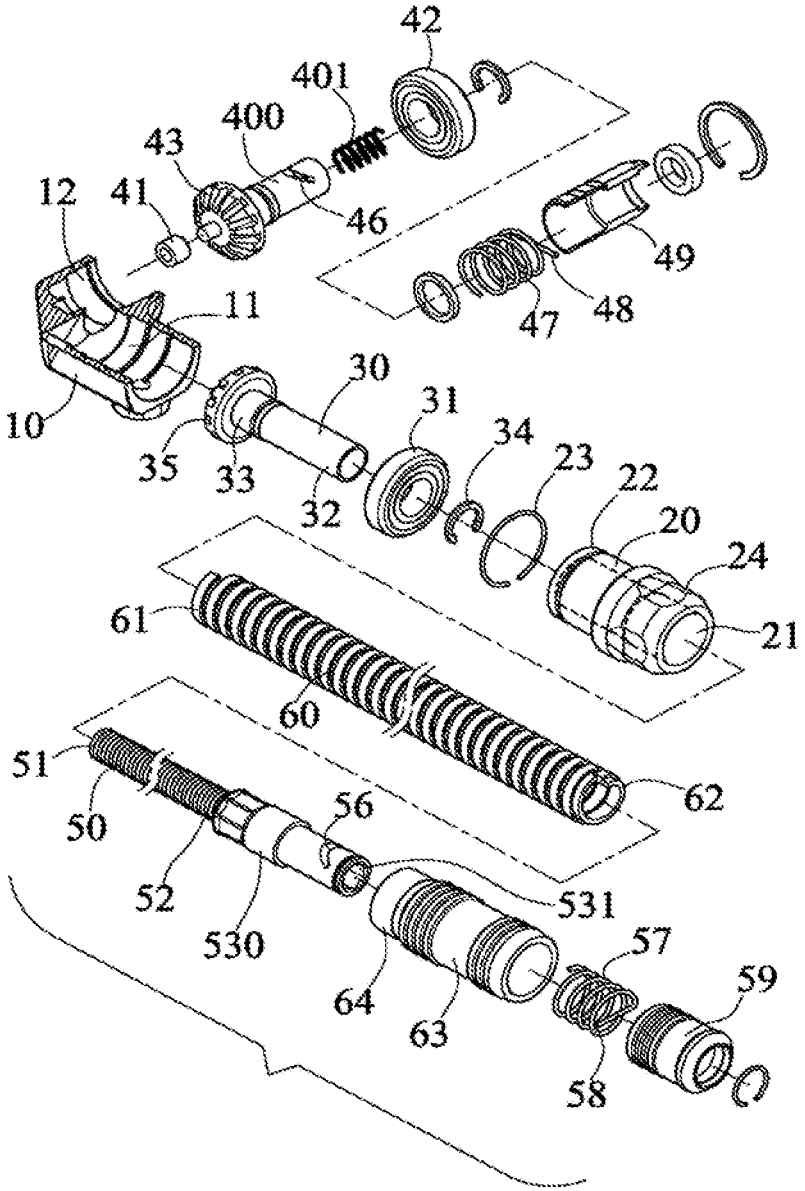
FIG. 4 is another exploded view similar to FIG. 1, illustrating the other arrangement of the tool holder device.
Figure 5:
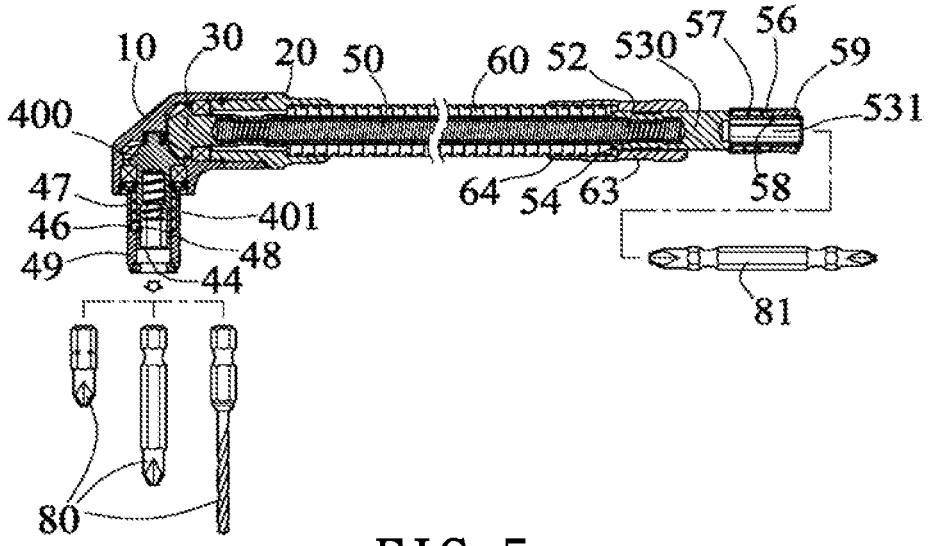
FIGS. 5, 6 are cross sectional views illustrating the operation of the tool holder device as shown in FIG. 4.
Figure 6:
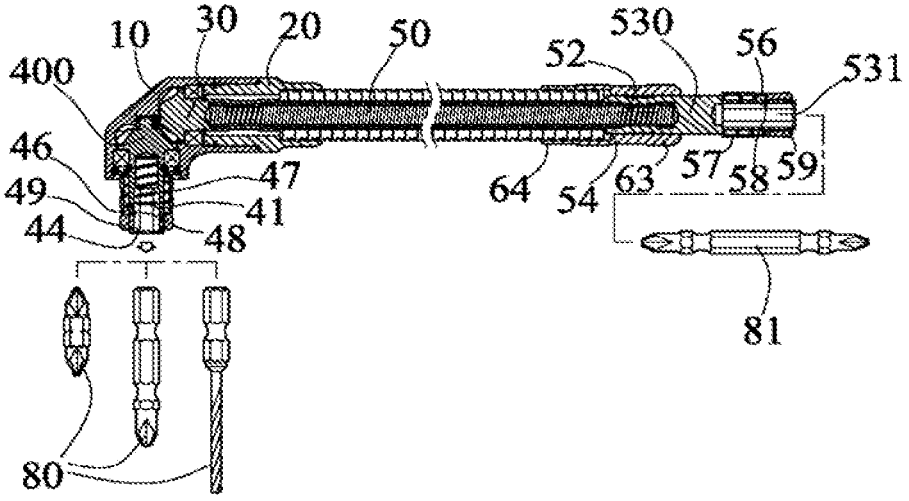

Alternatively, as shown in FIGS. 4-6, the shaft 400 may include a tilted groove 46 formed therein and communicative with the non-circular engaging hole 44 of the shaft 400 for selectively engaging with one end 48 of a spring biasing member 47, and a barrel or sleeve 49 is slidably attached or mounted or secured onto the shaft 400 and engageable with the spring biasing member 47 for selectively actuating or operating or forcing the one end 48 of the spring biasing member 47 to selectively engage with the tool member 80 and thus to selectively anchor or secure or retain or lock the tool member 80 to the shaft 400. The shaft 400 may further include another spring biasing member 401 engaged into the non-circular engaging hole 44 of the shaft 400 for selectively engaging with the tool member 80 and for selectively disengaging or releasing the tool member 80 from the shaft 400.

The stem 530 may also include a non-circular engaging hole 531 formed therein for selectively receiving or engaging with a tool element 81. The stem 530 may further include a tilted groove 56 formed therein and communicative with the non-circular engaging hole 531 of the stem 530 for selectively engaging with one end 58 of a spring biasing member 57, and a barrel or sleeve 59 is slidably attached or mounted or secured onto the stem 530 and engageable with the spring biasing member 57 for selectively actuating or operating or forcing the one end 58 of the spring biasing member 57 to selectively engage with the tool member 80 and thus to selectively anchor or secure or retain or lock the tool member 80 to the stem 530.

Figure 7:
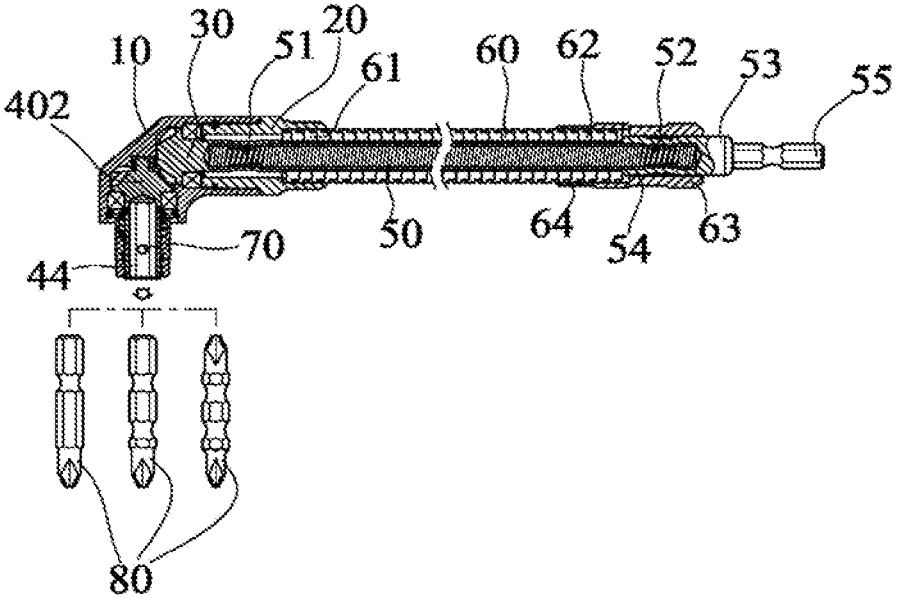
FIG. 7 is a further cross sectional view illustrating the further arrangement of the tool holder device.

Further alternatively, as shown in FIG. 7, the shaft 402 may include a spring biased detent 70 engaged therein and extendible or engageable into the non-circular engaging hole 44 of the shaft 402 for selectively engaging with the tool member 80 and for selectively anchoring or retaining or positioning the tool member 80 to the shaft 402 and for selectively disengaging or releasing the tool member 80 from the shaft 402.

In operation, as shown in FIGS. 2 and 3, the tool member 80 may be easily attached or mounted or secured to the shaft 40 and the receptacle 10 at a direction substantially perpendicular to the spindle 30 and the flexible shank 50 for allowing the tool member 80 to be easily and quickly engaged with the screws, bolts, or other driven tool elements or work pieces (not shown), in addition, the receptacle 10 and the tool member 80 may be easily engaged into a tiny working space for allowing the tool holder device to be easily actuated or operated in the tiny working space. It is to be noted that the engagement or attachment of the flexible shank 50 to the spindle 30 and the receptacle 10 allows the tool holder device to be easily actuated or operated in the tiny working space.

Accordingly, the tool holder device in accordance with the present invention includes an elbow member for carrying or holding or supporting or retaining the tool members or tool elements at the predetermined or required position relative to the tool body, and for allowing the tool members or tool elements to be suitably or effectively actuated or operated by various kinds of driving tools, and including a flexible structure for being suitably or effectively actuated or operated by the users and for allowing the tool holder device to be operated in a tiny working space.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A tool holder device comprising:

a receptacle including a first conduit and a second conduit formed therein and perpendicular to each other and communicative with each other, a spindle rotatably received and engaged in said first conduit of said receptacle with at least one bearing member, and said spindle including a first end portion, and including a second end portion engaged in said first conduit of said receptacle, and including a first bevel gear provided on said second end portion of said spindle and located close to said second conduit of said receptacle, a shaft rotatably received and engaged in said second conduit of said receptacle with at least one bearing member, and including a second bevel gear provided thereon for engaging with said first bevel gear of said spindle and for allowing said shaft to be rotated relative to said receptacle by said spindle, said shaft including an engaging hole formed therein for selectively engaging with a tool member, said shaft including a tilted groove formed therein and communicative with said engaging hole of said shaft, a spring biasing member including one end engaged with said tilted groove of said shaft, a housing including an end portion secured to said receptacle, and including a bore formed in said housing for receiving and engaging with said spindle, a flexible shank including a first end portion secured to said first end portion of said spindle and rotated in concert with said spindle, and including a second end portion extended out of said spindle and said receptacle, a stem including a first end portion secured to said second end portion of said flexible shank and moved in concert with said flexible shank, said stem including a second end portion, a flexible sheath engaged onto said flexible shank and including a first end portion secured to said receptacle, and including a second end portion, and a control ferrule including an end portion secured to said second end portion of said flexible sheath, and said stem being rotatably received and engaged in said control ferrule, wherein the first conduit includes a first inner bevel face which is slant relative to an axial about which the spindle rotates, and the first inner bevel face faces and is substantially parallel to a top bevel face of the first bevel gear which is slant relative to the axial about which the spindle rotates;

wherein the second conduit includes a second inner bevel face which is slant relative to an axial about which the shaft rotates, and the second inner bevel face faces and is substantially parallel to a top bevel face of the second bevel gear which is slant relative to the axial about which the shaft rotates;

wherein the housing further includes an outer flange, the outer flange is abutted axially against an distal end of the first conduit, and as viewed in an axial direction of the first conduit, the outer flange is aligned with the distal end of the first conduit;

wherein the flexible shank further includes at least two winding member layers sleeved with each other, and the at least two winding member layers obliquely wind counter to and slant to each other.

2. The tool holder device as claimed in claim 1, wherein said housing includes a knurled outer portion.

3. The tool holder device as claimed in claim 1, wherein the first conduit further includes an inner flange connected with the first inner bevel face, the at least one bearing member which is received in the first conduit is abutted axially against the inner flange and an distal end of the housing.

4. The tool holder device as claimed in claim 1, wherein the flexible shank includes more than two of said winding member layers, and every neighboring two of the more than two of said winding member layers obliquely wind counter to and slant to each other.

5. The tool holder device as claimed in claim 4, wherein the flexible shank further includes a central core wire around which the more than two of said winding member layers are disposed.

6. The tool holder device as claimed in claim 1, wherein the flexible shank further includes a central core wire around which the at least two winding member layers are disposed.

7. The tool holder device as claimed in claim 1, wherein a magnetic member is received in the engaging hole of the shaft.

8. A tool holder device comprising:

a receptacle including a first conduit and a second conduit formed therein and perpendicular to each other and communicative with each other, a spindle rotatably received and engaged in said first conduit of said receptacle with at least one bearing member, and said spindle including a first end portion, and including a second end portion engaged in said first conduit of said receptacle, and including a first bevel gear provided on said second end portion of said spindle and located close to said second conduit of said receptacle, a shaft rotatably received and engaged in said second conduit of said receptacle with at least one bearing member, and including a second bevel gear provided thereon for engaging with said first bevel gear of said spindle and for allowing said shaft to be rotated relative to said receptacle by said spindle, said shaft including an engaging hole formed therein for selectively engaging with a tool member, a housing including an end portion secured to said receptacle, and including a bore formed in said housing for receiving and engaging with said spindle, a flexible shank including a first end portion secured to said first end portion of said spindle and rotated in concert with said spindle, and including a second end portion extended out of said spindle and said receptacle, a stem including a first end portion secured to said second end portion of said flexible shank and moved in concert with said flexible shank, said stem including a second end portion, said stem including an engaging hole formed therein for engaging with a tool element, said stem including a tilted groove formed therein and communicative with said engaging hole of said stem, a spring biasing member including one end engaged with said tilted groove of said stem, a flexible sheath engaged onto said flexible shank and including a first end portion secured to said receptacle, and including a second end portion, and a control ferrule including an end portion secured to said second end portion of said flexible sheath, and said stem being rotatably received and engaged in said control ferrule, wherein the first conduit includes a first inner bevel face which is slant relative to an axial about which the spindle rotates, and the first inner bevel face faces and is substantially parallel to a top bevel face of the first bevel gear which is slant relative to the axial about which the spindle rotates;

wherein the second conduit includes a second inner bevel face which is slant relative to an axial about which the shaft rotates, and the second inner bevel face faces and is substantially parallel to a top bevel face of the second bevel gear which is slant relative to the axial about which the shaft rotates;

wherein flexible shank further includes at least two winding member layers sleeved with each other, and the at least two winding member layers obliquely wind counter to and slant to each other.

9. The tool holder device as claimed in claim 8, wherein the first conduit further includes an inner flange connected with the first inner bevel face, and the at least one bearing member which is received in the first conduit is abutted axially against the inner flange and an distal end of the housing.

10. The tool holder device as claimed in claim 8, wherein the flexible shank includes more than two of said winding member layers, and every neighboring two of the more than two of said winding member layers obliquely wind counter to and slant to each other.

11. The tool holder device as claimed in claim 10, wherein the flexible shank further includes a central core wire around which the more than two of said winding member layers are disposed.

12. The tool holder device as claimed in claim 8, wherein a magnetic member is received in the engaging hole of the shaft.

* * * * *